United States Patent [19]

Saunders

[11] Patent Number: 4,615,327

[45] Date of Patent: Oct. 7, 1986

[54] RESILIENTLY MOUNTED STABILIZER

[76] Inventor: Charles A. Saunders, 8380-36th Ave., Columbus, Nebr. 68601

[21] Appl. No.: 781,489

[22] Filed: Sep. 30, 1985

[51] Int. Cl.[4] ..... F41B 5/00

[52] U.S. Cl. ..... 124/89

[58] Field of Search ..... 124/24, 30 R, 24, 25, 124/88, 89

[56] References Cited

U.S. PATENT DOCUMENTS

| | | | |
|---|---|---|---|
| 3,412,725 | 11/1968 | Hoyt | 124/24 |
| 3,524,441 | 8/1970 | Jeffrey | 124/24 |
| 3,589,350 | 6/1971 | Hoyt | 124/24 |
| 3,628,520 | 12/1971 | Izuta | 124/89 |
| 3,670,712 | 6/1972 | Izuta | 124/89 |
| 4,135,486 | 1/1979 | Enomoto | 124/89 |
| 4,245,612 | 1/1981 | Finlay | 124/89 |

*Primary Examiner*—Richard C. Pinkham

*Assistant Examiner*—Gary Jackson

*Attorney, Agent, or Firm*—Henderson & Sturm

[57] ABSTRACT

A two stage resiliently mounted stabilizer adapted to be attached to an archery bow. The first stage of the stabilizer has a first housing resiliently mounted to a pedestal by use of a flat resilient washer and a tubular resilient member within the housing. The second stage of resilient mounting of the stabilizer includes a pair of tubular resilient members, one being disposed in such first housing and the second being disposed in a second housing. A second flat washer separates the two housings and a connecting member is used to interconnect the second and third tubular members and to tighten them together as well as to tighten the flat washer in a resilient fashion, to allow the second housing to move with respect to the first housing. Additional weights can be attached to the second housing if desired.

4 Claims, 3 Drawing Figures

RESILIENTLY MOUNTED STABILIZER

TECHNICAL FIELD

The present invention relates generally to an archery accessory and more particularly to an inertial stabilizer adapted to be attached to archery bows for the purpose of reducing vibration and torque of the bow during shooting thereof to produce a more consistent and accurate cast of arrows shot from such archery bows.

BACKGROUND ART

Stabilizers for archery bows have been known for many years. In a bow which does not have a stabilizer thereon, there is a tendency for the bow to be laterally and rotationally displaced upon the release of the arrow from the bow. During this lateral and rotational displacement, the handle section of the bow moves in a vibrating manner in a direction away from the arrow as it passes passed the bow handle. Inasmuch as the uitimate case of the arrow is affected throughout the time the bow string is moving from its drawn position to its forwardmost position due to the constant pressure exerted by the arrow nock by the bow string, it follows that any concurrent rotational displacement of the handle section or the arrow rest of the bow during this period will ultimately affect the resulting cast of the arrow.

There have been many different types of stabilizers used on archery bows and most of these stabilizers have been rigidly mounted to the bow. There have also been many attempts to provide a resilient mounting for archery bow stabilizers and these are represented by U.S. Pat. Nos. 4,245,612 to Finlay, 3,412,725 to Hoyt, 3,524,441 to Jeffery, 3,589,350 to Hoyt, 3,628,520 to Izuta, 3,670,712 to Izuta and 4,135,486 to Enomoto. Despite the vast amount of development in this art, there still remains a need for a resiliently mounted stabilizer which adequately stabilizes an archery bow to produce the consistent accuracy desired by archers.

DISCLOSURE OF THE INVENTION

The present invention relates to a two stage resiliently mounted stabilizer adapted to be attached to an archery bow. The first stage of the stabilizer has a first housing resiliently mounted to a pedestal by use of a flat resilient washer and a tubular resilient member within the housing. The second stage of resilient mounting of the stabilizer includes a pair of tubular resilient members, one being disposed in such first housing and the second being disposed in a second housing. A second flat resilient washer separates the two housings and a connecting member is used to interconnect the second and third tubular members and to tighten them together as well as to tighten the flat washer in a resilient fashion, to allow the second housing to move with respect to the first housing. The resultant structure has the first and second housing vibrations dampended by the first washer and the first tubular member and the vibrations of the second housing are not only dampened by that same structure, but such vibrations are further dampened by the resilient connection between the first housing and the second housing. Additional weights can be attached to the second housing if desired.

An object of the present invention is to provide an improved archery bow stabilizer.

Another object of the invention is to provide a resiliently mounted archery bow stabilizer with a two stage resilient mounting.

A further object of the present invention is to provide an archery bow stabilizer having a remarkably enhanced stabilizing affect on an arrow cast by a bow to which it is attached.

Other objects, advantages, and novel features of the present invention will become apparent from the following detailed description of the invention when considered in conjunction with the accompanying drawings.

BEST MODE FOR CARRYING OUT THE INVENTION

Figure 1:
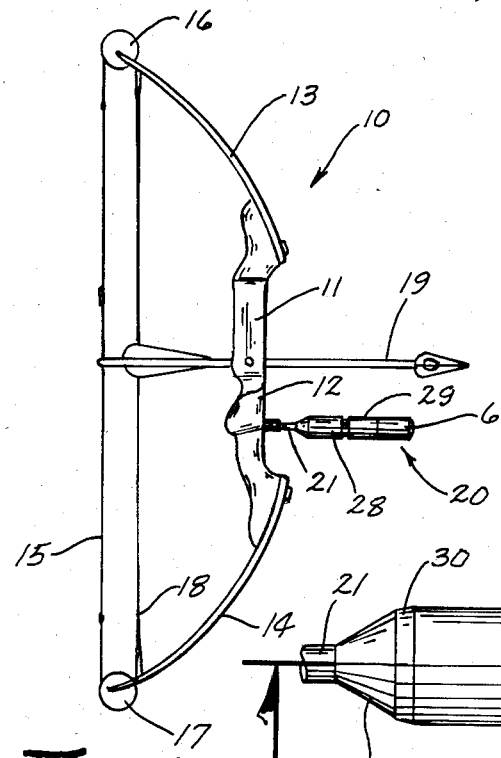
FIG. 1 shows an archery bow having a stabilizer attached thereto which is constructed in accordance with the present invention.

Referring now to the drawings wherein like reference numerals designate identical or corresponding parts throughout the several views, FIG. 1 shows a compound bow (10) of a convention type having a riser portion (11) with a handle (12). The riser (11) has a top limb (13) and a bottom limb (14) attached thereto. A string (15) extends over cams (16) and (17). The string (15) is further attached to a cable (18) at each end thereof, as is well known in this art. An arrow (19) is shown nocked onto the string (15) in readiness to be shot from the bow (10).

A stabilizer (20), constructed in accordance with the present invention, is threadably engaged into a threaded opening in the riser (11), which opening is provided in most commercially available bows.

Figure 2:
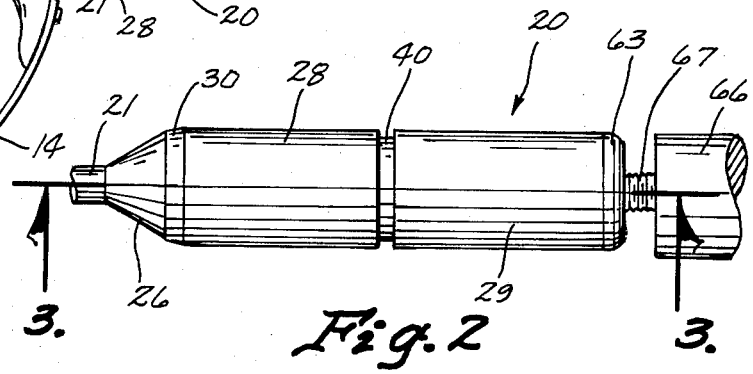
FIG. 2 is an enlarged side elevational view of the preferred embodiment of the stabilizer shown in FIG. 1.
Figure 3:
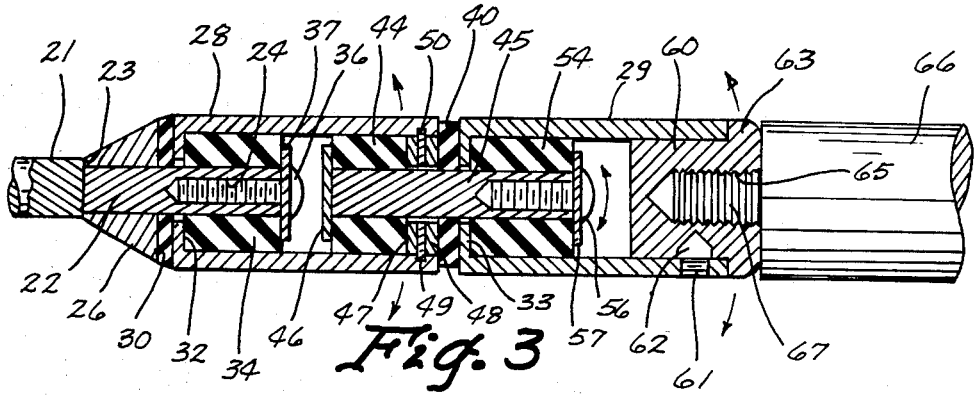
FIG. 3 is a further enlarged cross sectional view taken along line 3—3 of FIG. 2.

The stabilizer (20) has a metal pedestal (21) which has a threaded end on the left-most end as viewed in FIG. 2, although such threaded end is not shown in the drawings. Referring to FIG. 3, it is noted that the pedestal (21) has a reduced end (22) with a shoulder (23) which separates the larger and the smaller diameter portions of the pedestal (21). The pedestal (21) also has a threaded opening (24) in the smaller end (23) thereof. A metal pedestal crown (26) is slidably positioned over the portion (22) of the pedestal (21), as can readily be seen in FIG. 3.

Referring again to FIG. 2, it is noted that a first housing (28) is positioned closer to the bow (10) than a second housing (29). A rubber washer (30) is positioned around the member (22) and between the pedestal crown (26) and the first housing (28).

The first housing (28) and the second housing (29) each have an inwardly extending annular flange (32) and (33) respectively disposed thereon, which can readily be seen in FIG. 3. A first rubber tube (34) is in abutment with the annular flange (32), and this rubber tube (34) is compressed into place by use of a threaded bolt (36) threaded into the opening (24) in member (22). A steel washer (37) serves to increase the efffective area of contact of the end of the bolt (36) with the rubber tube (34). Consequently, when the bolt (36) is screwed down so that the washer (37) pulls the pedestal (21) towards the pedestal crown (26), this causes the washer

(30) to be compressed and it also causes the rubber tubing (34) to be compressed. This compression can be adjusted as desired, it being understood that the tighter that the bolt (36) is tightened down, the more resistant to movement the washer (30) and the rubber tube (34) will be and, conversely, the more loosely the connection the more loosely the bolt (36) is screwed into the pedestal portion (22), the easier that the stabilizer will bend and flex. Normally such compression is preadjusted during the manufacturing process at the factory.

Referring to FIG. 2, it is noted that the second housing (29) is resiliently mounted with respect to the first housing (28) to some degree by a rubber washer (40) disposed between the housings (28) and (29). It is further resiliently mounted by use of a second rubber tube (44) disposed within the first housing (28), having a connector member (45) extending therethrough. An enlarged head (46) rigidly is attached to one end of connector member (45). A pair of steel washers (47) and (48) are positioned at the ends of the housing (28) and have a snap ring (49) sandwiched therebetween, the snap ring (49) extending into an annular groove (50) around the end of the first housing (28). The snap ring (49) will consequently hold the rubber tube (44) in place; that is, this rubber tube (44) cannot move out of the housing (28) until and unless the snap ring (49) and washers (47) and (48) are removed therefrom.

Referring now to the second housing (29) as shown in FIG. 3, it is noted that a third rubber tube (54) is positioned in one end of the second houding (29) in abutment with the annular flange (33). A threaded bolt (56) is threadably engaged into the threads in the connector shaft (45) and a steel washer (57) serves to increase the effective area which is compressed by the bolt (56). When the bolt (56) is tightened down, the connector (45) will be pulling on and compressing the rubber tubes (44) and (54) and compressing the rubber washer (40) as the enlarged members (46) and (57) are pulled together against the respective rubber tubes (44) and (54). The extent of compression of these resilient members (40), (44) and (54) can also be adjusted by the extent of tightening of the threaded bolt (56). Normally this compression is preadjusted during the manufacturing process at the factory.

The end of the second housing (29) has a weight (60) telescopically disposed therein and has a set screw (61) extending into an opening (62) in the weight (60) for holding the weight (60) in place. The end (63) of the weight (60) serves as a stop to properly position the weight. The weight (60) has a threaded bore (65) therein for receiving additional and optional weights (66). The optional weights (66) have threaded stems (67) thereon.

Accordingly it will be appreciated that the preferred embodiment disclosed herein does indeed accomplish the aforementioned objects. Obviously many modifications and variations of the present invention are possible in light of the above teachings. It is therefore to be understood that, within the scope of the appended claims, the invention may be practiced otherwise than as specifically described.

I claim:

1. A stabilizer adapted to be attached to an archery bow, said stabilizer comprising:

a pedestal having one end externally threaded for threadable engagement with an archery bow, and the other end of said pedestal being internally threaded, said pedestal having a first external diameter on a major portion of said one end and a second external diameter on said other end thereof, said first diameter being larger than said second diameter, and a shoulder being disposed on an intermediate portion of said pedestal;

a pedestal crown having a central opening of a diameter at least as large as said second diameter, said pedestal crown encircling said pedestal, one end of said pedestal crown being in abutment with the shoulder on said pedestal;

a resilient washer having a central opening approximately the diameter of said second diameter, said resilient washer encircling said pedestal and being in abutment with the other end of said pedestal crown;

a first housing, said first housing being tubular in shape and having an outer diameter and an inner diameter, said first housing having an annular inwardly extending portion integrally attached to one end of said first housing, said annular inwardly extending portion being disposed onto said pedestal in abutment with said resilient washer and spaced radially outwardly from said pedestal;

a first resilient tube disposed within said first housing encircling said pedestal and having one end thereof in abutment with said inwardly extending portion on said first housing;

means threadably engaged into the internally threaded other end of said pedestal for contacting the other end of said first resilient tube and thereby pushing said one end of said resilient tube against the inwardly extending portion of said first housing and further causing said one end of the first housing to be tightly pushed against the resilient washer;

a second resilient tube disposed within said first housing, having one end closer to said one end of the first housing than the other end thereof;

means attached to the other end of said first housing in contact with the other end of said second resilient tube to prevent said second tubular member from sliding out of said first housing;

a second housing, said second housing being tubular in shape and having an outer diameter and an inner diameter, said second housing having an annular inwardly extending portion integrally attached to one end of the second housing;

a second resilient washer in abutment on one end with the other end of said first housing and on the other end with said one end of the second housing;

a third resilient tubular member disposed in said one end of the second housing, one end of said third resilient tubular member being in abutment with the annular inwardly extending portion on said second housing; and coupler means having one end for engagement with said one end of said second resilient tube and the other end in engagement with the other end of said third resilient tube, said coupler means including a shaft extending through said second and third resilient tubes and through said second resilient washer.

2. The stabilizer of claim 1 including weight means rigidly disposed in the other end of said second housing.

3. The stabilizer of claim 1 including means disposed in said weight means for selectively attaching an additional weighted member to said weight means.

4. The stabilizer of claim 1 including means for adjusting distance between said one end and the other end of said coupler means whereby said second and third resilient tubes and said second washer can be held in a compressed condition.

* * * * *